US008045420B2

(12) United States Patent
Newman

(10) Patent No.: US 8,045,420 B2
(45) Date of Patent: Oct. 25, 2011

(54) MEDICINE TIMER

(76) Inventor: David Edward Newman, Poway, CA (US)

( * ) Notice: Subject to any disclaimer, the term of this patent is extended or adjusted under 35 U.S.C. 154(b) by 485 days.

(21) Appl. No.: 12/315,737

(22) Filed: Dec. 8, 2008

(65) Prior Publication Data

US 2010/0142329 A1 Jun. 10, 2010

(51) Int. Cl.
*G04B 47/00* (2006.01)
*G04B 37/12* (2006.01)

(52) U.S. Cl. ..... 368/10; 368/109; 368/278

(58) Field of Classification Search ..... 368/10, 368/107–112, 278, 316–317
See application file for complete search history.

(56) References Cited

U.S. PATENT DOCUMENTS

| | | | | |
|---|---|---|---|---|
| 4,382,688 | A * | 5/1983 | Machamer | 368/10 |
| 4,483,626 | A * | 11/1984 | Noble | 368/10 |
| 4,660,991 | A * | 4/1987 | Simon | 368/10 |
| 4,725,999 | A * | 2/1988 | Tate | 368/10 |
| 5,408,443 | A * | 4/1995 | Weinberger | 368/10 |
| 6,169,707 | B1 * | 1/2001 | Newland | 368/10 |
| 6,449,218 | B1 * | 9/2002 | Lluch | 368/10 |
| 7,868,741 | B2 * | 1/2011 | Imai et al. | 340/309.16 |
| 2002/0149472 | A1 * | 10/2002 | Roe | 340/309.15 |
| 2003/0183642 | A1 * | 10/2003 | Kempker, Sr. | 221/2 |

* cited by examiner

*Primary Examiner* — Sean Kayes

(57) ABSTRACT

A medicine holder encloses one or more medicines which are in their original labeled containers, and emits an alarm signal when each dose is due. The alarm is automatically silenced when the holder is opened to retrieve the medicine. The timer is then automatically restarted when the holder is closed. The dose regimen is determined by an easily-operated selector switch, and is visibly displayed.

20 Claims, 12 Drawing Sheets

MEDICINE TIMER

BACKGROUND OF THE INVENTION

The invention relates to medicine timers, and more particularly to medication-holding enclosures with automatic timer means and alarm means.

Most medicines must be taken on a periodic schedule or dose regimen to obtain maximal effectiveness and safety. Many people find it difficult to follow a dose regimen, even with the best intent, due to distractions or disability or just being busy. This leads to missed or doubled doses, with potentially serious consequences. A wide assortment of medication holders and timers have been developed to remind people when a dose is due. However, all prior products fail to provide the combination of security and ease-of-use required for broad acceptance. The prior art medicine holders and timers can be categorized in four types, depending on the functions they perform for the patient:

Prior art medicine timers of type 1 are simply interval timers with an alarm function that alerts the patient when a dose is due (such as U.S. Pat. No. 7,330,101 to Sekura). Type 1 products fail to contain or identify the medication itself, and this leads to medicine mix-ups. Also there is no way for the timer to be reset automatically, by the act of medication-taking, and this causes further dose errors. For example, U.S. Pat. No. 7,054,231 to Valerio, U.S. Pat. No. 5,953,288 to Chappell, and U.S. Pat. No. 4,361,408 to Wirtschafter describe timers attachable to a pill bottle, but these fail to reset automatically when the medicine is taken.

Prior art of type 2 is a pill-carrier with timer means (such as U.S. Pat. No. 7,100,793 to Baum, U.S. Pat. No. 6,574,165 to Sharma, U.S. Pat. No. 6,449,218 to Lluch, U.S. Pat. No. 6,314,384 to Goetz, U.S. Pat. No. 6,169,707 to Newland, U.S. Pat. No. 5,915,558 to Girvetz, or U.S. Pat. No. 5,990,782 to Lee). Type 2 products hold the medicine or medicines, and provide a timed alarm. The products may also feature automatic restarting of the timer when the unit is opened. However, all type 2 medicine timers require that the medication be physically separated from the original labeled container that identifies the medicine. This is a major fault, potentially leading to medication mix-ups since many pills look similar. Also, there is no way to tell if a pill is outdated, such as a leftover medication still in the carrier from a previous prescription. Expired medication, although visually indistinguishable from the new medication, is potentially harmful. For these reasons, most people rely on a label to identify the medication and to provide a dispensing or expiration date to avoid such dosing errors. Therefore it is important to keep the medicine together with the original labeled container.

Prior art type 3 is a timer cap (such as U.S. Pat. No. 7,408,843 to Brandon, U.S. Pat. No. 7,382,692 to Hildebrandt, or U.S. Pat. No. 7,362,660 to Hildebrandt, or U.S. Pat. No. 6,859,136 to Gastel) that fits on the original labeled medicine container. The timer cap may be an add-on, or it may be a replacement for the original container cap. The product emits an alarm when each dose is due. The alarm is silenced, and the timer re-started automatically, when the cap is removed. Since the identifying label remains with the medication, type 3 products avoid the problem of medicine mis-identification discussed above. Unfortunately, type 3 products are useless for liquids and ointments that interfere with the timer circuit. Also, the type 3 products are so small it is difficult or impossible to change the timer battery; hence the product is normally thrown away as soon as the battery runs out. Also, it is difficult to select the timing interval since there is no room for a selection control such a knob. To set the dose time interval, type 3 products require the user to perform a complex series of steps, generally necessitating careful study of an instruction manual.

Another problem with the timer cap product is that it fits only one size of medicine container. Often the original container is incompatible with the timer cap, and so the medicine must be put into another container that fits the cap. This separates the medication from the identifying label, which defeats the purpose of keeping the medicine and its label together.

Prior art type 4 products are complex dispenser machines (such as U.S. Pat. No. 7,302,311 to Varts, U.S. Pat. No. 6,961,285 to Niemiec, U.S. Pat. No. 6,259,654 to de la Huerga, U.S. Pat. No. 5,838,224 to Andrews, U.S. Pat. No. 5,706,257 to Rothman, U.S. Pat. No. 5,289,157 to Rudick, or U.S. Pat. No. 4,275,384 to Hicks). Such products hold single or multiple medicines and are programmed to dispense or release each medication according to a schedule. Such machines are bulky and expensive, and are difficult to program. Some of these devices require separation of the medications from pharmacist containers or modifications to the pharmacist container for operation. Dispensing machines are notoriously prone to jamming, even when a single pill becomes broken during dispensing. Most people want to control their medications themselves and are reluctant to take a pill that some kind of machine simply dumps out.

What is needed is a simple and convenient medicine enclosure that accommodates medicine in its original labeled container, the medicine being in pill form or liquid form or ointment or any other form of medicine, while providing a fully automatic timed alarm to indicate when each dose is due, according to an easily-selected dose regimen. Here "easily" means that the user must be able to select the dose interval intuitively and without consulting a manual. Just for comparison, a toaster that has a single "light-medium-dark" switch is easy to set, whereas the clock on a VCR is not. Essentially all prior art medicine timers are difficult to set by this criterion. They involve multiple, non-intuitive steps that must be carried out in the right order, and are not user-friendly in any sense of the term.

BRIEF SUMMARY OF THE INVENTION

The invention is a medicine holder and timer that includes an openable enclosure accommodating the medicine, still in its original labeled container, and that produces an automatic timed alarm signal controlled by an easily-settable dose-interval selector. Importantly, the medicine is kept in its original medicine container which is labeled to identify the medicine. The invention holds one container or multiple containers. The operation of the invention is entirely automatic, requiring no action from the user other than simply taking the medicine when so alerted. Unlike virtually all prior medicine timers, the selector is easy to use. It is so easy to use, anyone with a pulse can select the dose regimen without consulting a manual.

The invention comprises a base, a cover, a sensor, a timer, a selector, and an alarm wherein:

1. the base is a solid structure supporting a labeled medicine container, which contains a medicine that is to be taken in doses at a particular dose frequency, 2. the cover, cooperating with the base, encloses the labeled medicine container when the cover is in a closed position, and admits access to the labeled medicine container when the cover is in an open position, 3. the sensor detects the open or closed position of the cover, and triggers the timer when the cover position is changed, 4. the selector, comprising a switch controllable by the user, selects a selected delay time from among a plurality of predetermined delay times, according to the particular dose frequency, 5. the timer, after being triggered by the sensor, waits a delay time equal to the selected delay time, and then activates the alarm, and 6. the alarm produces signals indicating that it is time to take a dose of the medicine.

The labeled medicine container is any jar or bottle or blister pack or box or the like, into which a competent authority has placed a medicine, and to which the competent authority has affixed information identifying the medicine. The medicines may have any form—pills, syrups, ointments, or other form, or combinations thereof. The identifying information may include a label, or printing directly on the container, or other means for presenting data. When the medicine is a prescription medicine, the competent authority is a pharmacist or a dispensing physician. When the medicine is a non-prescription (over-the-counter) medicine, the competent authority is the medicine's manufacturer or distributor. Manufacturers' labels usually provide further critical information such as the expiration date and counterindications, whereas prescription labels include the patient's name, doctor's name and telephone number, dose regimen, and dispensing date. Clearly, it is important to keep the medicine and the identifying label together, thus avoiding common dosing errors.

The dose regimen is a periodic schedule specifying when the medicine is to be taken. The dose regimen may be expressed as a dose frequency or a dose interval. A dose frequency is the number of doses per day. The dose time interval is equal to the inverse of the frequency times 24 hours. The common dose regimens are: one dose per day or a 24 hour interval, two doses per day or a 12 hour interval, three doses per day or an 8 hour interval, and 4 doses per day or a 6 hour interval. Other dose regimens may be specified in a similar way.

The inventive base is any solid structure or assembly having sufficient capacity to support the labeled medicine container. When multiple medicines are to be taken at the same time, multiple medicine containers may fit together on the base, and the same alarm will apply to all the medicines. When multiple medicines are to be taken with different dose regimens, the invention may provide multiple stations with independently controlled alarms.

The inventive cover is any solid structure that, cooperating with the base, has an open position and a closed position. When closed, the cover and base substantially surround the labeled medicine container. When the cover is open, the labeled medicine container is accessible and directly retrievable for taking a dose. The intent of the cover is not to prevent or restrict access to the medicine, but rather to enable the timer to determine when a dose is actually taken, so that the next alarm may be timed appropriately.

Examples of a base and cover are diverse. The base may be a plastic platform, and the cover may be a glass or plastic shape that fits over it. The enclosure may be a wooden open-side cabinet with a wooden door, or a metal open-top box with a metal lid. A plastic cylindrical bucket shape may be closed with a plastic cap. The cover may be attached to the base using a pivot or hinge or flexible member. The cover may be connected to the base with threading or latches. The cover may slide open. The cover may be simply placed over the base, and not attached to the base at all. The cover and base may have particular optical properties, such as transparency to allow viewing of the labeled medicine container, or opacity to prevent such viewing. Multiple covers may be used interchangeably with the base so as to accommodate medicine containers of different size and shape. The cover may be held closed by magnets or detents or friction bosses or other holding means, and may be urged open by pressing a button or lever or other control.

The inventive sensor is any electronic or mechanical transducer mounted on the base or the cover, that reacts to the open or closed position of the cover. Normally the sensor has a property such as electrical conductivity, which changes in response to the cover being opened or closed, and communicates that information to the timer with wires. An example of a sensor is a button switch mounted on the base so as to be compressed when the cover is closed, and released when the cover is open. Another example is a magnetic proximity sensor mounted in the cover, that responds to the approach of a magnet or a ferromagnetic object in the base, thereby detecting the opening and closing of the cover. A tilt-switch mounted on the cover is a suitable sensor when opening the cover involves tilting or rocking. An optical interrupter serves as such a sensor when the cover interrupts an optical or infrared beam when open or closed.

The inventive timer is any means for activating an alarm following a specific time delay. Normally the timer is a triggerable electronic circuit or mechanical device that can be started or reset by the sensor, and then generates a particular time delay according to the dose regimen, and then activates the alarm The timer may be started or triggered when the medicine dose is taken, as indicated by the cover being opened. Alternatively, the timer may start measuring a dose interval immediately upon completion of the previous such interval, without waiting for the patient to take the dose. In either mode, the timer is started automatically without any action being required of the user, other than simply taking the medication.

An example of a timer is an osillator with a counter and a decoder. The oscillator is a source of electronic pulses having a particular frequency, such as a crystal oscillator or an R-C (resistor-capacitor) astable circuit. Alternatively, pulses with a particular frequency could be derived from mains or line power which typically alternates at 50 or 60 Hz. An electronic counter counts the pulses. The counter may be an up-counter which is incremented on each pulse, or a down-counter which is decremented. The up-counter normally comprises a number of individual binary counter stages, each stage providing a parallel output signal that changes when the stage is incremented. A decoder, such as a multi-input NAND logic gate, is connected to the outputs of specific stages so as to trigger only when a specific count total is reached. Normally the count total is equal to the desired delay time divided by the oscillator period. The decoder produces an output signal upon detecting that specific count total, thereby providing the desired delay time and determining when the next dose is due. A plurality of such decoders can be connected to the various counter outputs, so that each decoder will respond at different times, corresponding to the various dose time intervals. Then the selector selects one of those decoder output signals, according to the dose regimen selected, and connects that one decoded signal to the alarm. Thus the counter and decoder provide the time delay corresponding to the selected dose regimen, and then activate the alarm.

Alternatively, the counters could be a down-counter. The down-counter is first pre-loaded with a particular number or pre-load value when the cover is opened or closed. Normally the pre-load value is the dose time interval in seconds times the oscillator frequency in Hertz. A plurality of such pre-load values can be stored in memory locations, and the selector can select which memory location to draw the pre-load value from. Then the down-counter is decremented to zero by the pulses from the oscillator. When the down-counter reaches zero, it produces an output signal that activates the alarm.

An alternative timer circuit comprises a monostable circuit that produces a prolonged output pulse, the duration being equal to the desired dose time interval. The trailing edge of the pulse activates the alarm. The pulse length produced by the circuit is related to a resistor and a capacitor, which are selected by the selector. For example, the selector can determine the time interval by connecting one resistor, from among a plurality of resistors, to the monostable so that the selected resistor, cooperating with a fixed capacitor, generates the desired time delay.

Another example of a timer circuit is a digital processor with means for receiving time information from a time standard. The processor is any circuit capable of performing arithmetic. The time standard could be a radio station such as WWV, or a GPS (global positioning system) satellite, or an internet source. Or, the time standard may be a built-in circuit that indicates the current time. A digital clock with a triggerable time-interval alarm function comprises such a timer.

In one mode of operation, the processor records or memorizes a time value provided by the time standard when the inventive enclosure is opened or closed. Then the processor periodically receives signals from the time standard showing the current time. The processor subtracts the start time from the current time value to determine an elapsed time, and then compares the elapsed time to the selected dose interval. When the elapsed time interval equals or exceeds the dose time interval, the processor activates the alarm. In another mode of operation, the processor adds the selected dose interval value to the start time, thus determining an end time. The processor then periodically compares the current time with the calculated end time, and activates the alarm when the current time exceeds the end time. In either mode, the selector determines which dose time value is used by the processor for such comparisons, that value being selected from a plurality of dose time values stored in the processor.

The inventive selector is an electronic or mechanical control, operable by a patient or care-giver, and connected to the timer or the alarm so as to determine the time delay. The user selects a selected dose regimen from among a plurality of possible dose regimens, by adjusting the selector while viewing indicia or other displays showing the selected dose regimen. Normally the selector has a user-operated portion, a user-informing portion, and an electronic portion. The user-operated portion is that control or handle or knob or button or other device that the user directly manipulates. The user-informing portion is a means for indicating to the user which dose regimen is selected, including indicia or pointers or displays that the user directly views. The electronic portion, normally not visible to the user, includes mechanical contacting means or electronic gates or analog switches or other electromechanical components which influence the timer so as to produce the selected time delay. The electronic portion, the user-operated portion, and the user-informing portion together comprise the selector.

The selector determines when the alarm is activated. The selector may accomplish this by changing a value or component connected to the timer so that the timer produces the desired delay time, such as a resistor controlling an oscillator frequency. Alternatively, the selector may select one conductor from among a plurality of conductors carrying signals at a different time delays. The selector then connects the selected conductor to the alarm, so that the alarm will be activated only at the selected time delay. As a further option, the selector may select a digital value from a particular memory element, such as a counter pre-load value that governs the time delay. From the user's perspective, it doesn't matter which electronic method is employed, so long as the dose frequency is easy to set and easy to see.

An example of a selector control is a knob with labels or indicia corresponding to each dose regimen supported by the invention, and an unmistakable indicator such as a pointer showing which of the dose regimens has been selected. The associated selector circuit may comprise a multi-position click-stop rotary switch having a contact arm that contacts one of a number of radial terminals when turned by the knob. Another example of a selector control is a pushbutton switch that the user can operate to change the selected dose time interval, for example by cycling through a number of dose time intervals upon each button push. Another example is a bank of pushbuttons, with each pushbutton corresponding to a dose regimen. The associated selector circuit may comprise an analog multiplexer that connects one and only one alarm activation signal to the alarm, or a digital demultiplexer that selects a time-determining digital value.

Operationally, the selector may determine the time delay in a variety of ways, depending on the operation of the timer. If the timer is an oscillator or a monostable circuit controlled by a resistor, the selector could connect the timer to one resistor from among a plurality of resistors, so as to regulate the timer. If the timer uses a series of counters and a plurality of decoder circuits to mark time intervals, the selector may be a demultiplexer that allows one and only one such decoder signal to activate the alarm. The selector could connect a particular memory location to the timer, the memory location holding a time interval value or other digital information, so as to control the time delay. Since timers are relatively cheap, it is quite feasible to provide a complete timer for each dose regimen, and then the selector selects only one output to activate the alarm. A further example of a selector circuit is an array of logic gates or analog switches, wired so as to connect the timer or the alarm to only one time-interval determining means, from among a plurality of time-interval determining means.

The inventive selector control is extremely simple to use and user-friendly, and provides an obvious visual indicator of the selected time interval or dose frequency. For example a selector control can indicate the selected dose interval by pointing to labels, one for each supported dose regimen. The selector could have a pointer marked on it, and the labels could be mounted on another surface of the invention. Or, the labels could be on the selector, and a pointer mounted on something else. Alternatively, the selected time interval or dose frequency may be shown by display means such as an array of LED's (light-emitting diodes), a 7-segment display, an LCD (liquid crystal display) screen, or other user-informing means. A defining feature of the present invention is that the selected dose regimen is visible and obvious to the person adjusting the selector.

The inventive alarm is any means for emitting a signal of sufficient intensity to get the patient's attention. The alarm may produce a sound or light signal, or a mechanical signal such as a vibrator or a flag. The alarm may produce wireless signals such as radio or infrared signals, which can be received so as to inform the user that the time has come to take a dose.

The alarm is normally deactivated as soon as the cover is opened. A single sensor may be employed for starting the timer and squelching the alarm, or there may be two separate sensors for the alarm and timer functions. The invention may provide both a visible alarm and a sonic alarm, in which case the sonic alarm may be silenced as soon as the cover is opened, but the visible alarm may remain on until the cover is re-closed. The advantage of leaving the light on is that bathrooms tend to be dim, especially at night, so the light from the visible alarm might serve as a helpful nightlight while the user retrieves the medicine.

The invention may provide another control to deactivate the alarm, such as a pushbutton. This may be a quicker and more convenient means for silencing an acoustical alarm. Even when such a switch is provided, the user could still choose to silence the alarm by opening the cover if preferred. A silencing switch normally deactivates the alarm for one dose period only, and the alarm is re-activated upon the next dose time. However, the invention may include another silencing control that turns off the acoustical alarm entirely, as when an acoustical alarm is not desired.

The invention may provide displays to show information of interest to the user. For example the invention could indicate the elapsed time since last dose, or the time remaining until next dose, or the number of doses taken so far, or the number of doses remaining, or the number of doses that have been missed. Likewise the open or closed state of the cover may be indicated by red and green lights or other indicators, thereby revealing when the cover has not been closed all the way.

There are times when a patient may wish to take a dose earlier than the normal dose period, for example when going to bed. Some medications permit early dosing within limits. The invention may include means for informing the patient that an early-dose time has arrived, or equivalently to alert the patient when it is still too soon to safely take the next dose. This can be accomplished by arranging two timers for each of the dose regimen selections, one producing a delay time equal to the selected dose time, and the other timer producing a shorter delay time equal to the minimum acceptable spacing between doses. Then the shorter timer could indicate that it is safe to early-dose by some signal, such as by illuminating colored LED's or by changing a message on an LDC screen. Later, when the normal dose time is up, the regular dose alarm is activated.

As an alternative, the same early-dose functions can be accomplished by successively using a single timer. First the timer is set for a time interval equal to the normal dose time minus the early-dose window, or 7.5 hours for a regimen of 3 doses per day (assuming that the early-dose window is 30 minutes). When that interval is up, the early-dose indicator is lit and the timer is automatically re-started with the interval set for the early-dose window, 30 minutes in the example. When that 30-minute period is up, the timer activates the normal alarm. Preferably the normal dose alarm produces a clearly different signal from the early-dose signal. For example, the invention may illuminate a red light before the early-dose time occurs, and then illuminate a yellow light when the early-dose timer completes, and then illuminate a green light and also produce an acoustical alarm when the full dose interval is complete. The red light means that it is too early to take the medicine. The yellow light means that an early dose is permitted. The green light means that the normal dose time is up.

There are times when a patient may wish to take a dose later than the normal dose period, for example when still asleep. The invention may enable such late-dosing by use of multiple timer means with different time intervals and distinct alarm signals, or by programming a single timer means with different intervals as explained for early dosing. For example, the invention may produce a light signal at the normal dose time, followed by a sonic alarm 30 minutes later if the dose has not yet been taken. The light signal means "You can take the dose", and the sonic signal means "TAKE THE DOSE NOW!"

The invention may also guard against a dose being taken too early by producing a distinct sound when the cover is opened too early. For example, if the normal dose alarm is a happy tone sound, then the invention can produce an abrasive buzzer sound if the cover is opened too early. The timer may be so arranged that, if the cover is opened too early but is re-closed within a very short time such as 2 seconds, then the time interval measurement remains uninterrupted. Presumably this is too brief a time to retrieve the medicine container.

If the cover is opened too early and remains open longer than the very short time, then presumably the dose has been removed from the container. This may indicate that the patient has taken a dose early, or it may mean that the patient is leaving the house and has decided to carry the next dose with him and will be responsible for taking it on time. In either case, the system can get the patient back on schedule by finishing the first dose time measurement as usual, and—without activating the alarm—then immediately starting the next dose time interval. At the end of the second time interval, the normal alarm is activated as usual. This compensates for the early dose extraction and returns the patient to the prescribed schedule.

The invention may provide means for a global reset, which restarts the timer and all other functions at an initial state. This may be useful when the user first started the prescription at an inconvenient time, and the user wants to shift the dose schedule to a convenient time. The invention may perform such a global reset whenever the power is switched off and on. Or a separate reset switch may be provided for this purpose.

The invention may include a special-access control, which is a button or switch that enables access to the medicines without interrupting the timer. For example, it may be necessary to access the medicine container to count the remaining doses. In that situation the user must be able to retrieve the labeled container temporarily, and then put it back, but without resetting the timer. The special-access control allows the user to do this by bypassing the enclosure sensor switch. First, the user presses the special-access control, then opens the enclosure, then withdraws the labeled medicine container, then closes the enclosure, and then releases the special-access control. The labeled medicine container can be returned to the enclosure by reversing the steps. While the special-access control is activated, the timer remains unaffected by the opening and closing of the enclosure.

Sometimes the user is to take multiple medicines at different times. To serve this user, the invention may include multiple stations, each station having a separate cover and a separate dose-interval selector and a separate alarm for each station. The system could emit a sonic alarm whenever any one of the stations comes due, and a flashing light on each cover to indicate which of the medicines is to be taken. Thus the patient would be called to the unit by the acoustical alarm, and would be directed to one of the covers by the flashing light on that cover.

The invention solves all of the problems mentioned with regard to prior art medicine timers. The invention keeps the medicine and its original labeled container together, thereby eliminating all of the most common sources of medicine mix-ups. It also protects against use of expired medication, which prior pill carriers cannot. The invention provides an easily-settable and easily-readable selector to select the desired dose regimen, thereby avoiding a common source of frustration. The invention accommodates medicines in any form, and holds multiple medicines when they are to be taken together, unlike prior systems. In some embodiments, the invention permits special-access so that the medicine or the container may be inspected without interrupting the timer. In some embodiments, the invention provides an indication of when a dose may be taken early, or when a dose is over-due.

When this invention becomes widely available as a household product, it will eliminate the most common dosing problems associated with taking a medicine on a dose regimen.

DETAILED DESCRIPTION OF INVENTION

Figure 1:
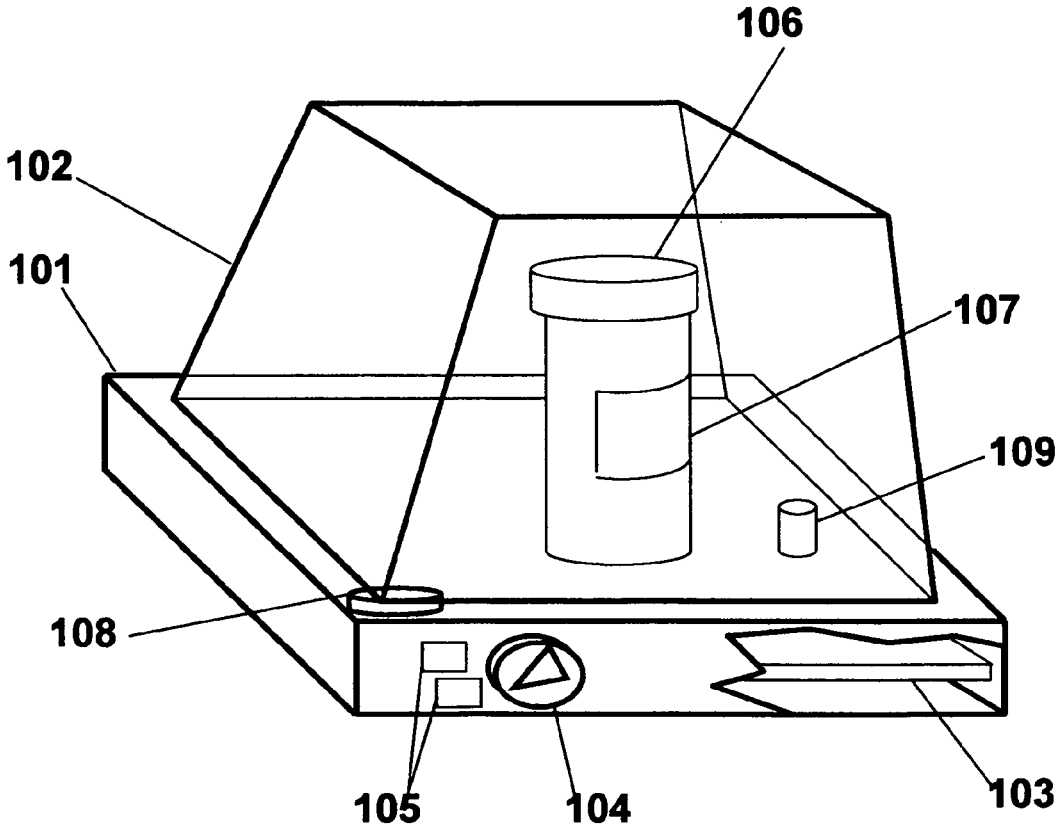
FIG. 1 is a schematic diagram of the invention, in perspective and partially cut away, including a transparent cover in the closed position, and holding a labeled medicine container.

Referring to FIG. 1, a medicine holder according to the invention includes an enclosure comprising a plastic base 101 with a transparent plastic cover 102, a timer 103 comprising an electronic circuit board, and a selector knob 104 with indicia 105. A labeled medicine container 106, containing medicine (not shown) and with an identifying label 107, sits upon the base 101 under the cover 102. The timer 103 is mounted inside the base 101 which is partially cut away. A button switch 108 is mounted on the base 101 so that the cover 102 compresses the switch 108 when the cover 102 is in a closed position, as shown, and releases the switch 108 when the cover 102 is in an open position. A light 109 such as an LED is mounted on the base 101 to provide a visible alarm signal when each dose is due to be taken.

The knob 104 selects the dose time interval or frequency. The indicia 105 indicate which dose rate or dose interval has been selected. The timer 103 includes a crystal-controlled oscillator, counters, and decoders (not shown) to demark the selected dose time interval and activate the alarm light 109. The timer 103 is started when the switch 108 is compressed by the closing of the cover 102. The timer 103 then measures the desired dose interval, as selected by the knob 104, and then powers the light 109. When the cover 102 is again opened, it releases the switch 108, which resets the timer 103 and deactivates the light 109.

Figure 2A:
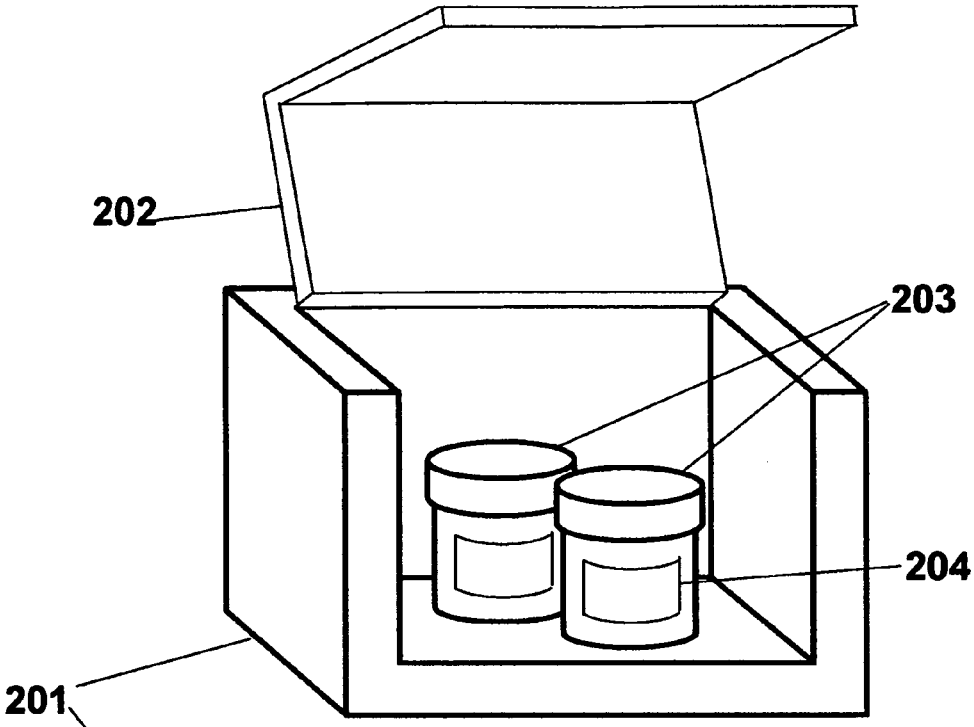
FIGS. 2*a* and 2*b* show an embodiment with an opaque enclosure in the open and closed positions, respectively.
Figure 2B:
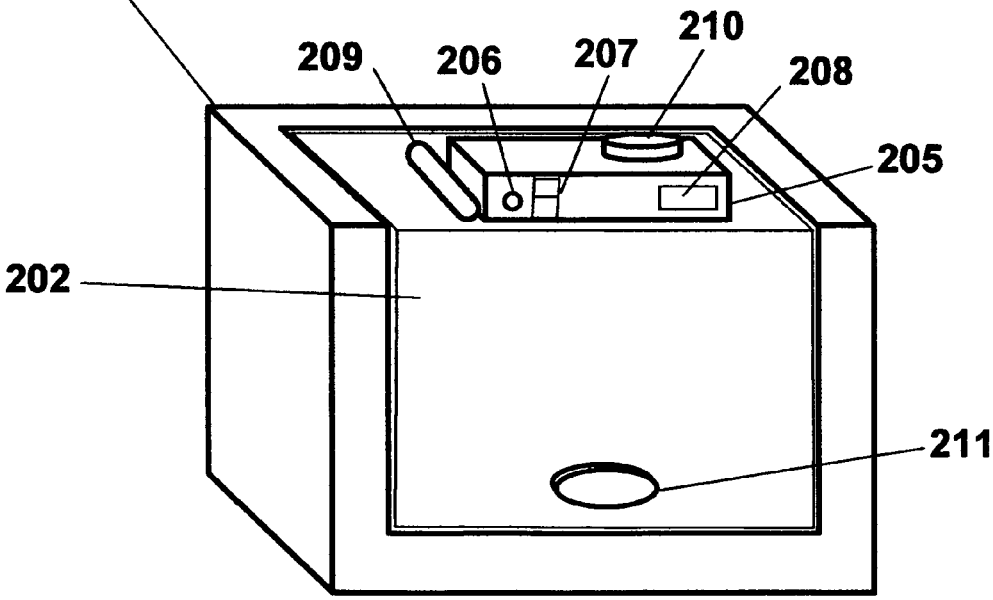

FIG. 2 shows an alternative embodiment of the invention. A metal case 201 is attached to a hinged, rotatable metal cover 202 which is openable and closeable. The cover 202 is shown in an open position in FIG. 2*a* and a closed position in FIG. 2*b*. Labeled medicine containers 203 with identifying labels 204 sit on the case 201. The medicine containers 203 contain medicines (not shown) which are to be taken at the same time; hence they can both be accommodated together in the invention. The cover 202 allows access to the labeled medicine containers 203 when the cover 202 is in the open position. The cover 202, in cooperation with the case 201, encloses the labeled medicine containers 203 when the cover 202 is closed. A module 205, mounted on the cover 202, contains a time-measuring circuit (not shown). A button 206, when pressed, cycles through a plurality of preset dose regimens, thereby selecting the desired number of doses per day. A seven-segment LED display 207 shows the selected number of doses per day. A buzzer 208 produces an alarm when each dose is due. A tilt-switch 209 is mounted on the cover 202 to sense the opening and closing of the cover 202. An alarm-stop button 210 silences the buzzer 208 when pressed. A handle 211 is provided.

Figure 3:
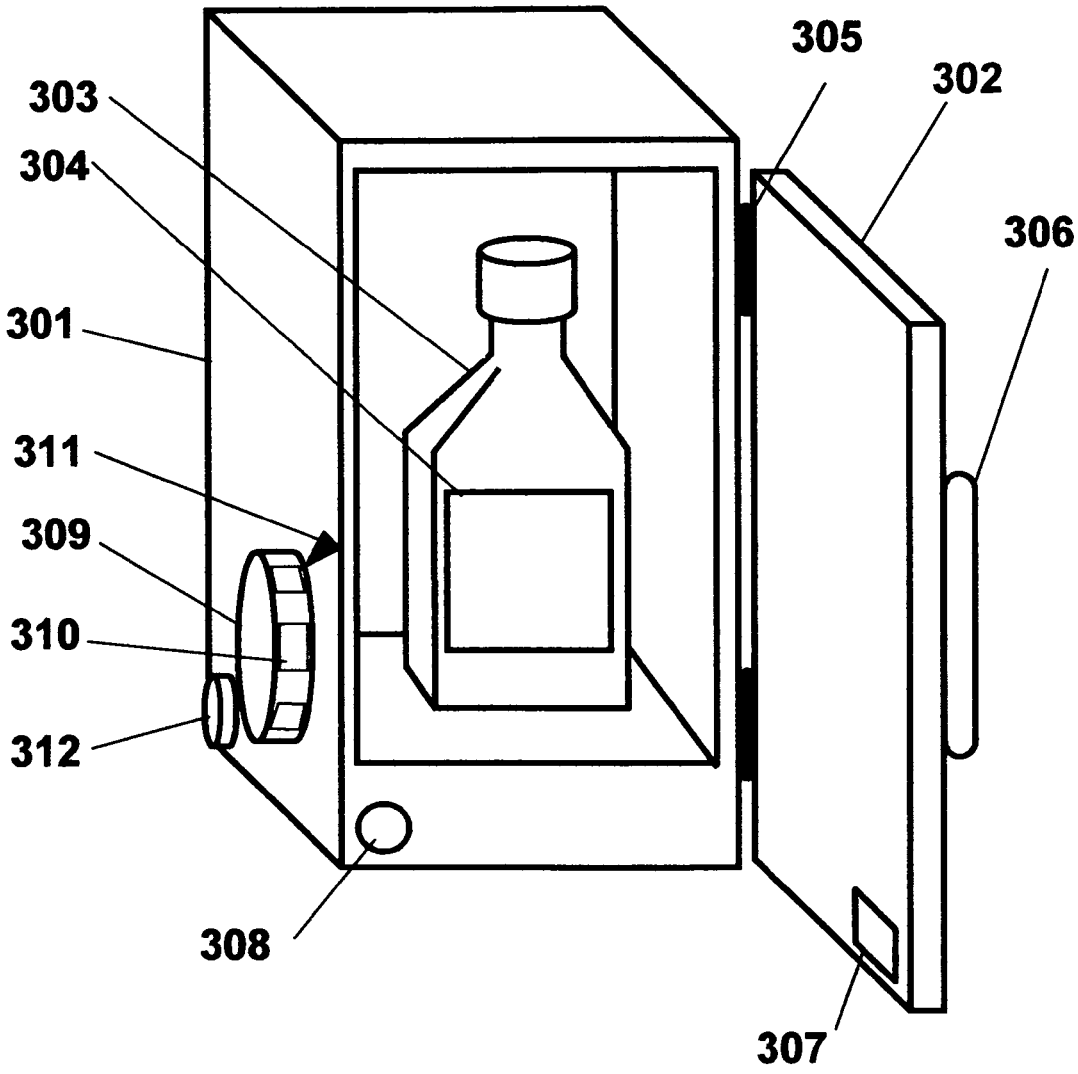
FIG. 3 shows a third embodiment including a medicine bottle.

FIG. 3 shows an inventive embodiment as a wooden cabinet 301 and door 302 enclosing a medicine bottle 303 with an identifying label 304. The door 302 has hinges 305 and a handle 306 and a magnet 307. Built into the cabinet 301 is a switch 308 which has two functions. The switch 308 is a magnetic sensor that changes its conductivity state when the magnet 307 is near the switch 308. Also, the switch 308 includes ferromagnetic material to attract the magnet 307 so as to keep the door 302 closed. A knob 309 selects a time interval from among a plurality of predetermined time intervals, each interval being indicated by indicia 310 on the knob 308. The selected time interval is indicated by a pointer 311. A radio receiver circuit (not shown) is built into the cabinet 301 to receive time information from a radio station so as to measure the selected time interval, starting when the switch 308 is closed. After the selected time interval, the invention sends a wireless signal indicating that the time interval has expired. Also provided is a special-access switch 312 that overrides or bypasses the magnetic switch 308, so as to permit opening of the door 302 without interrupting the time interval measurement.

Figure 4:
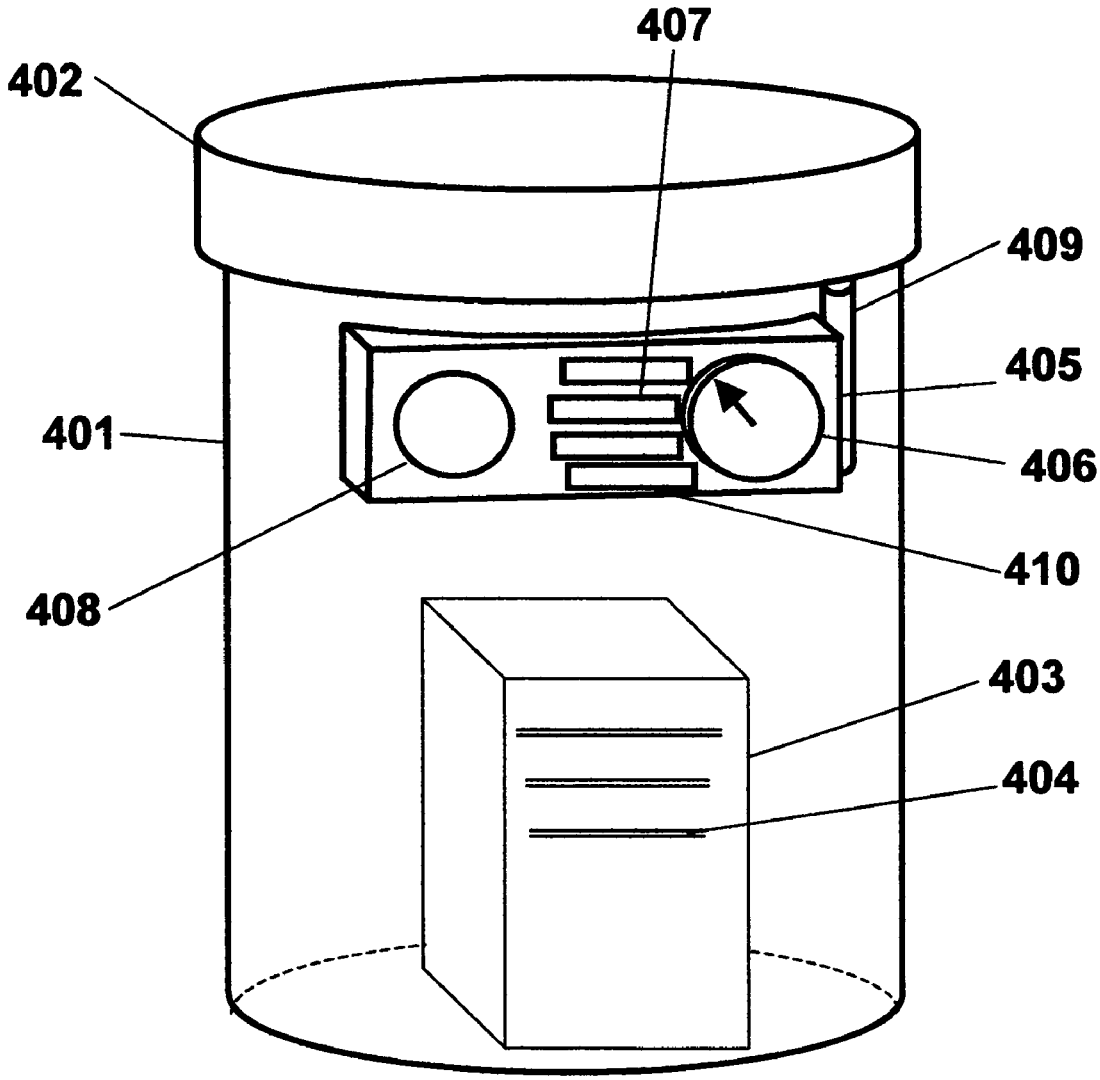
FIG. 4 shows a fourth embodiment in a cylindrical configuration, enclosing a box-shaped medicine container.

FIG. 4 shows an inventive embodiment with the appearance of a large classical pill enclosure, including a translucent amber plastic vial 401 and a white plastic cap 402. A labeled medicine container in the form of a box 403 with imprinted medicine identification information 404 is in the vial 401. A timing assembly 405 is attached to the vial 401. The assembly 405 includes a knob 406 that selects a timing interval, and also indicates the selected interval as shown by the labels 407. A colored field 408 changes color to indicate when the next dose is due. The assembly 405 includes an infrared proximity sensor 409 that detects the opening and closing of the cap 402, which initiates the time interval measurement.

Figure 5:
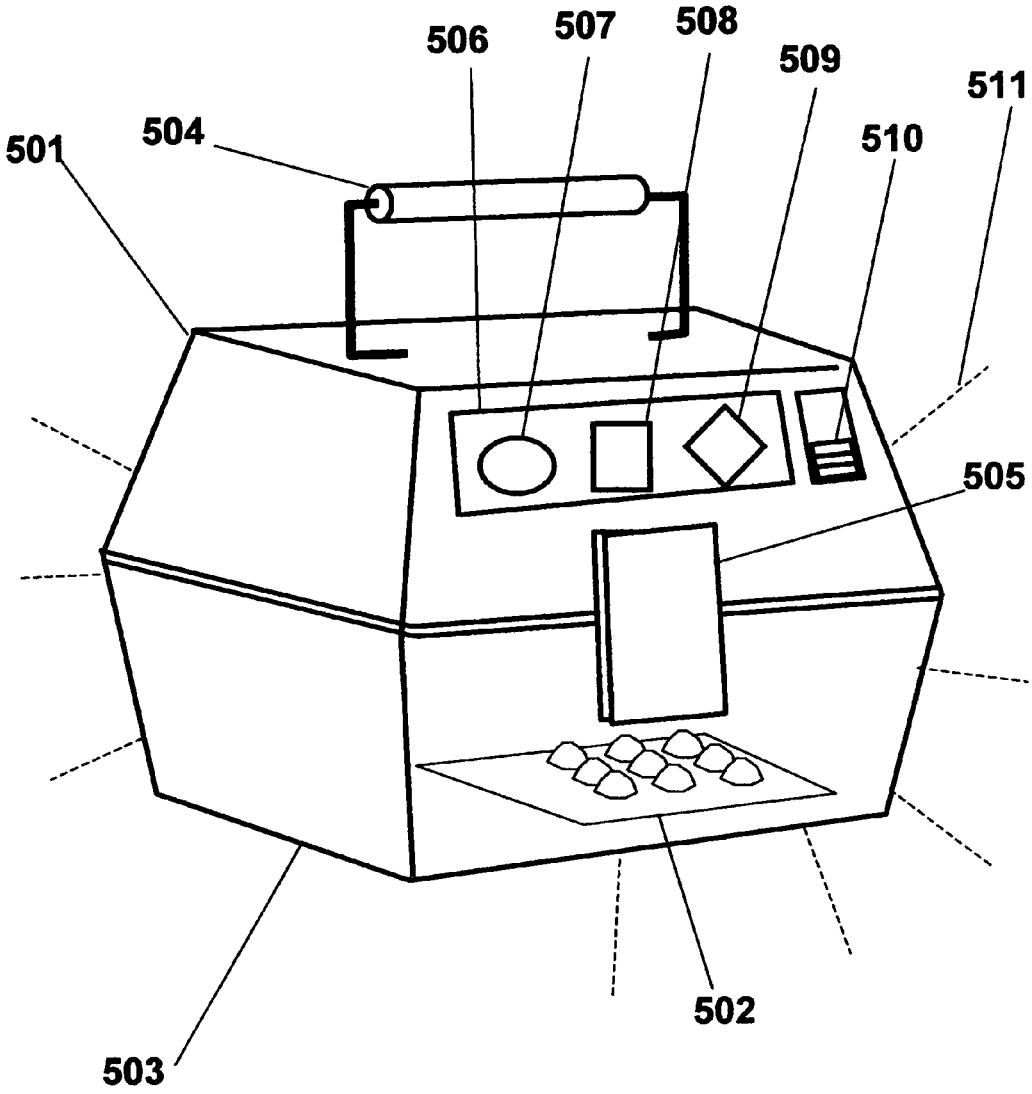
FIG. 5 shows a fifth embodiment in the form of a tote-box with a handle.

FIG. 5 shows an embodiment as a tote-box, which is a small portable latchable carrier. The embodiment includes a lower portion 501 into which labeled medicine blister-pack containers 502 are placed, and a top portion 503 which, cooperating with the lower portion 501, encloses the labeled medicine containers 502. The lower and upper portions 501 and 503 are made of a diffusive or cloudy plastic material that allows light to pass through but prevents a clear view of the contents. A handle 504 and latch 505 are attached to the top portion 503. A touch-sensitive LCD screen 506 includes a button region 507, a number display 508, and a second number display 509, and an on-off switch 510. Pressing the button region 507 causes the selected time interval to be cycled through a plurality of predetermined time intervals, while the number display 508 shows the selected time interval in hours. The second number display 509 shows other information such as the time remaining until the next dose is due. The embodiment is shown in an alarm-active state, with the entire box emitting a flashing light as suggested by the dashed lines 511. The light is produced by an array of lamps (not shown) within the upper portion 503, and is diffused by the material of the upper and lower portions 501 and 503, thus giving the appearance that the entire tote-box is flashing.

Figure 6:
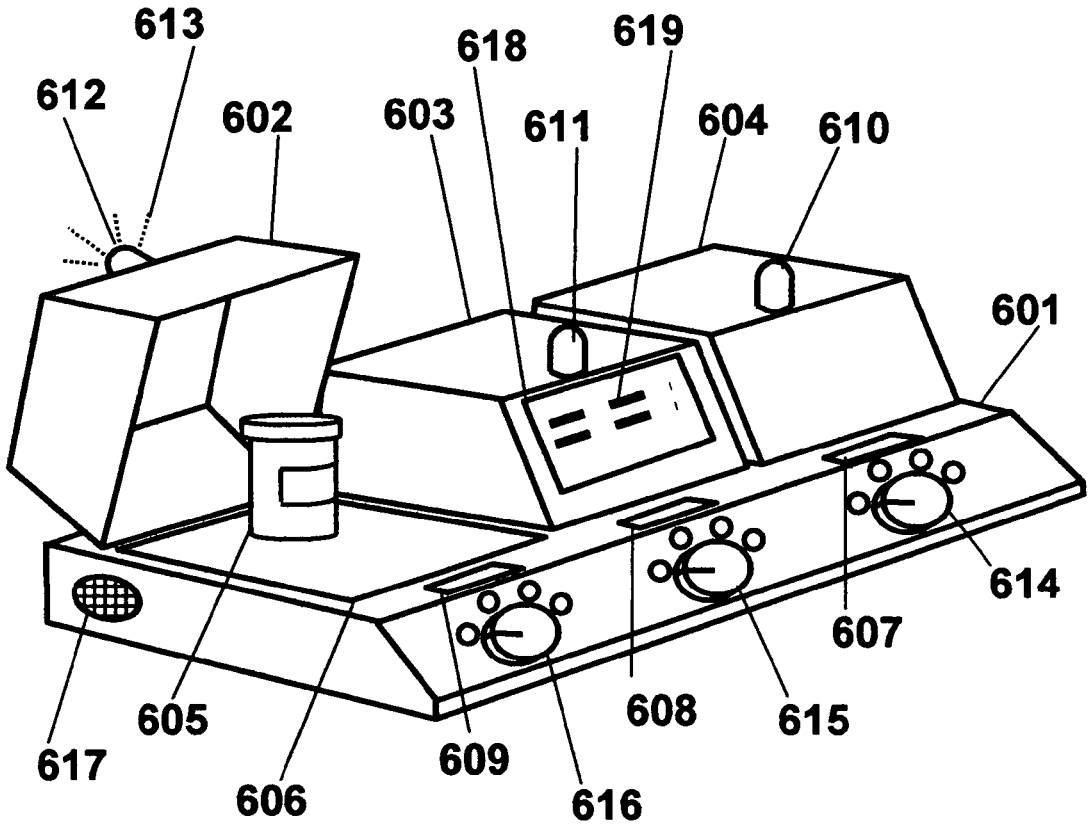
FIG. 6 shows an embodiment with three independent medicine holders.

FIG. 6 shows an embodiment with three independent medicine holder stations mounted on a base 601. A first cover 602 is shown in the open position, and two other covers 603 and 604 are shown closed. A medicine container 605 sits in a designated region 606 that can be enclosed by the first cover 602. Each cover is held closed by a magnet (not shown), and can be opened by pressing a button 607, 608, or 609 which flips open the corresponding cover. A lamp 610, 611, and 612 is mounted on each cover 602, 603, and 604. One lamp 612 is shown in an alarm state, emitting a flashing signal as indicated by dotted lines 613. Each station has an independent timer (not shown) inside the base 601. Each timer is controlled by a separate selector knob 614, 615, and 616. When a dose is due at any of the three stations, a buzzer 617 is activated as well as the corresponding lamp. When the user presses the opening button 609 to open the cover 602 having the alarm signal 613, the buzzer 617 ceases and the corresponding timer is re-started. The lamp 612 is extinguished a short time later. The embodiment also shows a display screen 618 mounted on one of the covers 603, displaying information 619 such as the amount of time remaining until the next dose is due. Alternatively, each cover 602, 603, and 604 could have a separate screen.

Figure 7:
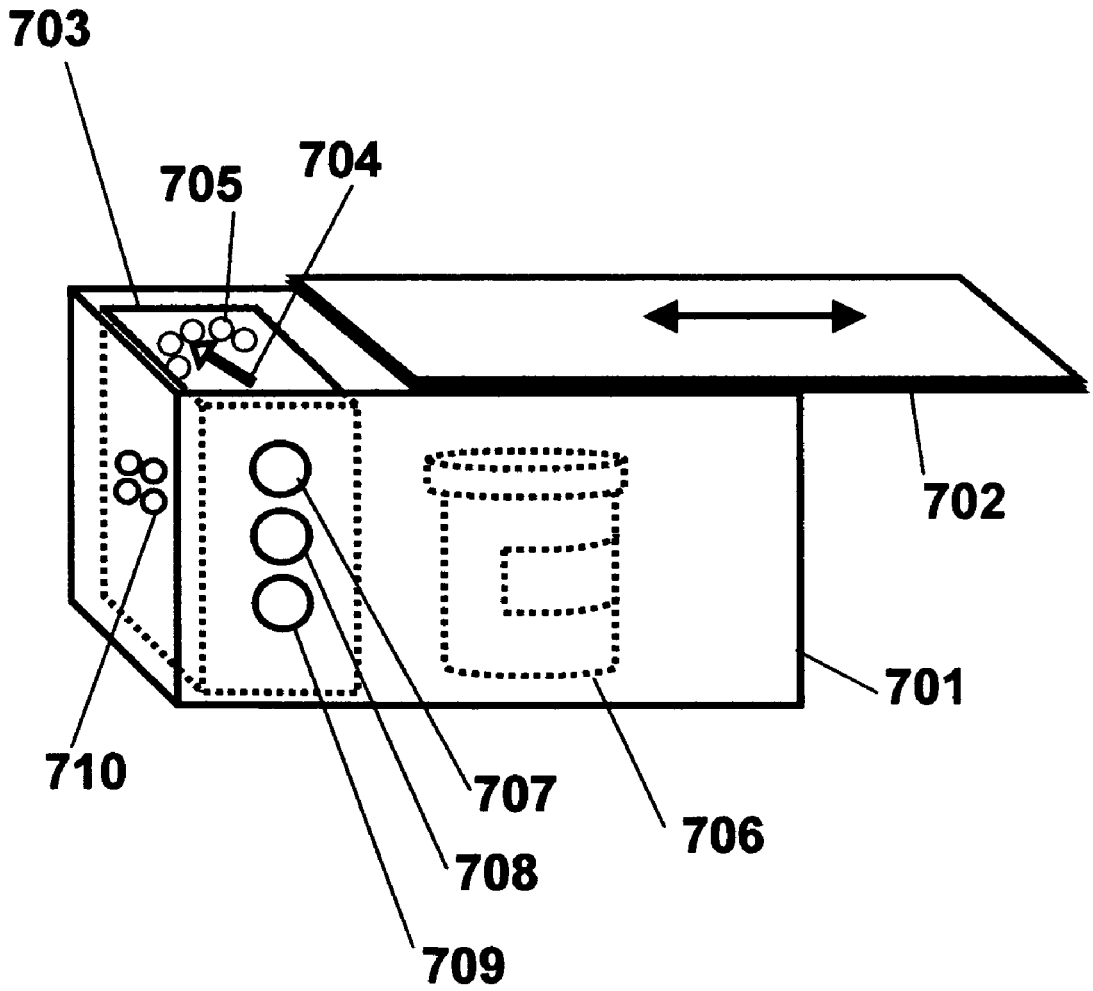
FIG. 7 shows a box with a sliding top and multiple alarm means.

FIG. 7 shows an embodiment as a wooden open-top box 701 with a slider lid 702. A timer module 703 is inside the box 701 and is shown dotted where obscured by the box 701. A selector switch 704, with labels 705 indicating various dose regimens, selects the normal dose time interval. The module 703 also has a contact switch (not shown) to detect the opening and closing of the lid 702. Inside the box 701 is a medicine container 706, shown dotted. The embodiment includes a red lamp 707, a yellow lamp 708, and a green lamp 709, and a buzzer 710. The lamps 707, 708, and 709 are intended to resemble a stoplight. The various alarms tell a patient when it is permissible to take a dose early, when the normal dose time is up, and when a dose is overdue. When the lid 702 is first closed, the contact switch starts the timer module 703 measuring the selected dose time interval minus 30 minutes (the presumed early-dose time window). The timer module 703 illuminates the red lamp 707 during this first time interval, indicating that the medicine is not to be taken. When the dose time interval minus 30 minutes is expired, the timer module 703 turns off the red lamp 707 and turns on the yellow lamp 708, indicating that an early dose may be taken. Also, the timer module 703 automatically starts again, but now the interval is 30 minutes. At the completion of that time interval, the timer module 703 turns off the yellow lamp 708 and turns on the green lamp 709, indicating that the normal dose time is up. The timer module 703 again starts another 30-minute time interval (the presumed late-dose time window). At the completion of the final 30-minute interval, the timer module 703 activates the buzzer 710 and also causes the green lamp 709 to begin flashing, thus indicating that the dose is overdue. When the lid 702 is opened, this causes the contact switch to open, which resets the timer module 703, which extinguishes all alarms. Also, the timer module 703 activates the buzzer 710 if the lid 702 is opened while the red lamp 707 is on, thereby alerting the user not to take a dose too soon.

Figure 8:
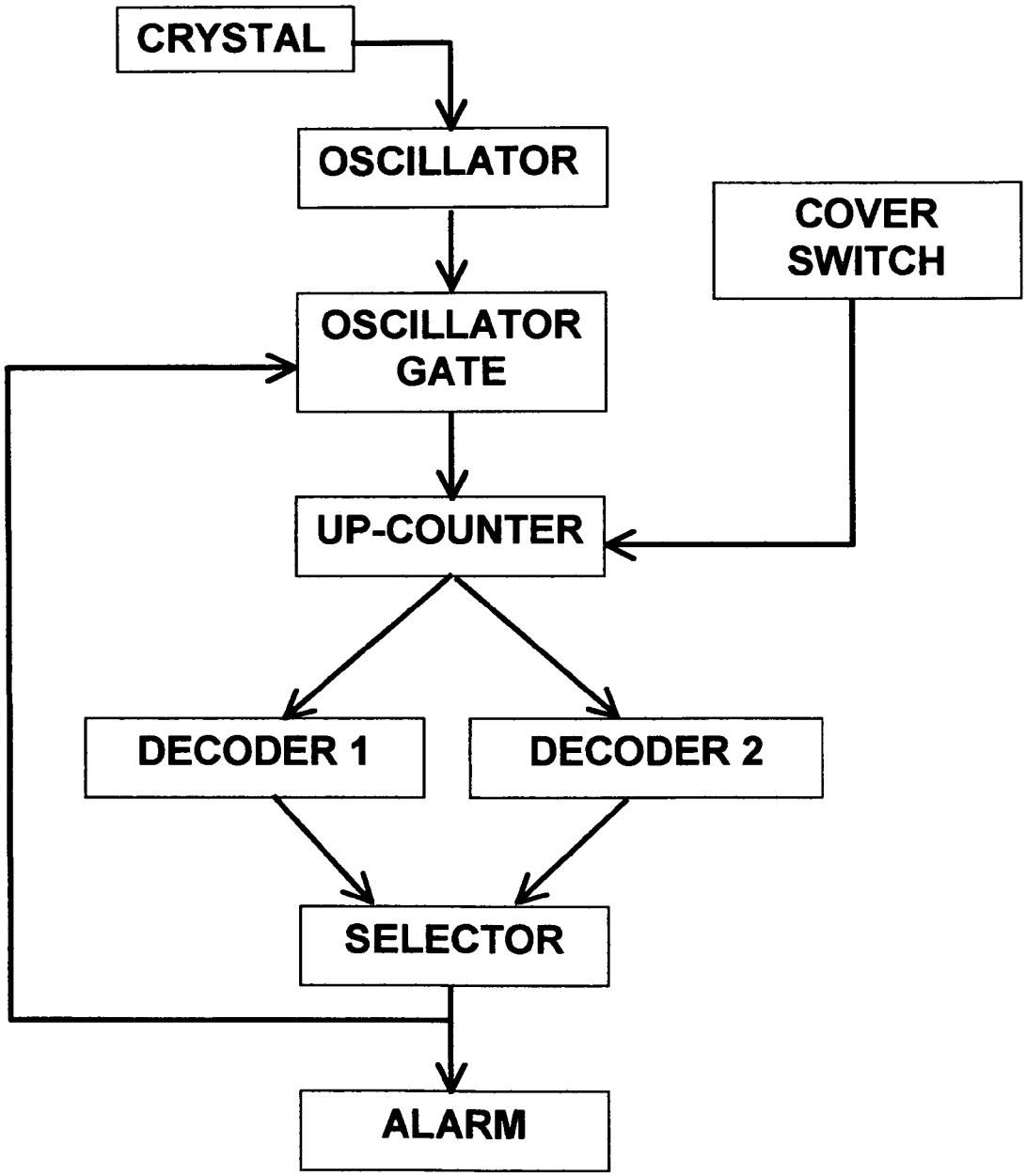
FIG. 8 is a circuit schematic showing a timer with a crystal oscillator.

FIG. 8 is a schematic diagram of a timer according to the invention. A crystal oscillator drives a binary up-counter through a logic gate called the oscillator gate. The counter drives a number of parallel output lines which are monitored by a plurality of decoders, each decoder being set to detect a different preset time interval and to produce an output signal when that time interval is obtained. The output signals from the various decoders go to the selector switch, which connects one of the decoder signals to an alarm and also to the oscillator gate. When the selected decoder reaches a preset time interval, the alarm is activated. Although the oscillator continues producing pulses, the oscillator gate is inhibited or prevented from passing further clock pulses to the counter, thus keeping the counters unchanged and keeping the alarm activated. When the cover switch then opens, the counter is reset to zero, which deactivates the alarm and enables the oscillator gate to again pass pulses to the counter. In this way, the cover switch starts the counter when a dose is taken, and then the counter counts up until the selected decoder produces an output signal indicating that the selected dose interval has passed. That signal goes through the selector and activates the alarm and inhibits the oscillator gate. The alarm remains activated until the cover switch is opened, at which time the timer is again reset, the alarm is deactivated, and the cycle starts over.

To consider a more specific embodiment for FIG. 8, the oscillator may be a 32768 Hz integrated oscillator, the oscillator gate may be a CMOS (complementary metal-oxide semiconductor) 4011-type NAND gate, the counters may be three 4040-type 12-bit binary counters, and each decoder may be a 4068-type 8-input AND/NAND gate. The inputs of the 4068's are wired to certain output pins of the 4040 counters so as to be triggered at one of the predetermined time delays. The output signals of the various decoders go to the selector, which passes one such decoded signal to the alarm and to the oscillator gate. Thus the alarm is activated upon completion of the selected time delay, and remains activated as long as the oscillator gate is inhibited. The cover switch is connected to the reset inputs on the counters, so that the counters are zeroed when the cover is opened. When the counters are reset, the decoder inputs no longer satisfy the NAND criterion, so the decoder outputs return to the non-triggered state, which turns off the alarm and releases the inhibition of the oscillator gate. In this way the alarm is deactivated and the timer is reset and re-started automatically when the cover is opened.

Figure 9:
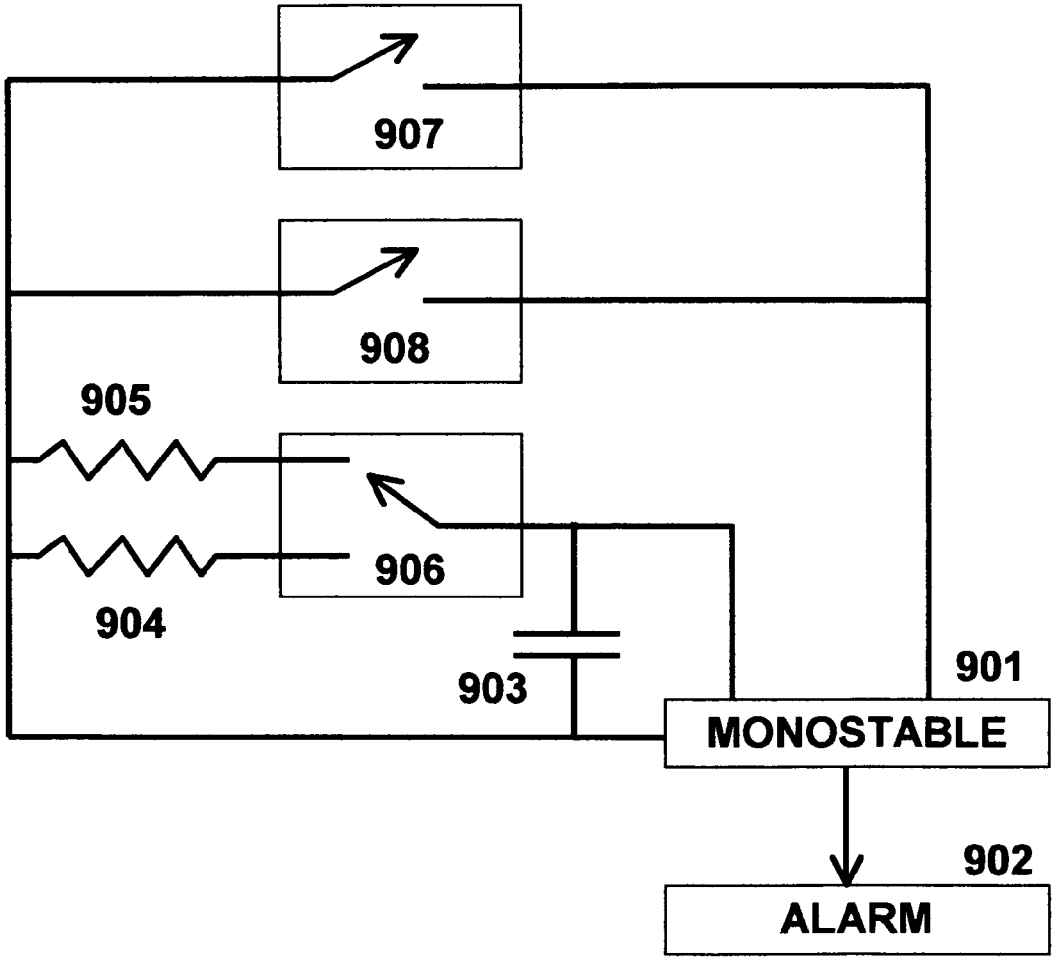
FIG. 9 is a schematic diagram of a timer using a monostable circuit.

FIG. 9 is a schematic of an alternative timer means. A monostable circuit 901 generates an output pulse, which activates an alarm 902 upon the trailing edge of the pulse. The duration of the pulse is determined by a capacitor 903 and a first resistor 904 or a second resistor 905. A selector switch 906 is a single-pole-double-throw switch that selects either the first or second resistor 904 or 905. A cover switch 907 resets the monostable circuit 901 when the cover switch 907 is open. When the cover switch 907 is again closed, it lifts the reset condition, so as to start another time interval measurement. The embodiment includes a special-access control 908 which is another switch wired in parallel with the cover switch 907. By closing the special-access control 908, the cover may be opened without affecting the monostable circuit 901.

Figure 10:
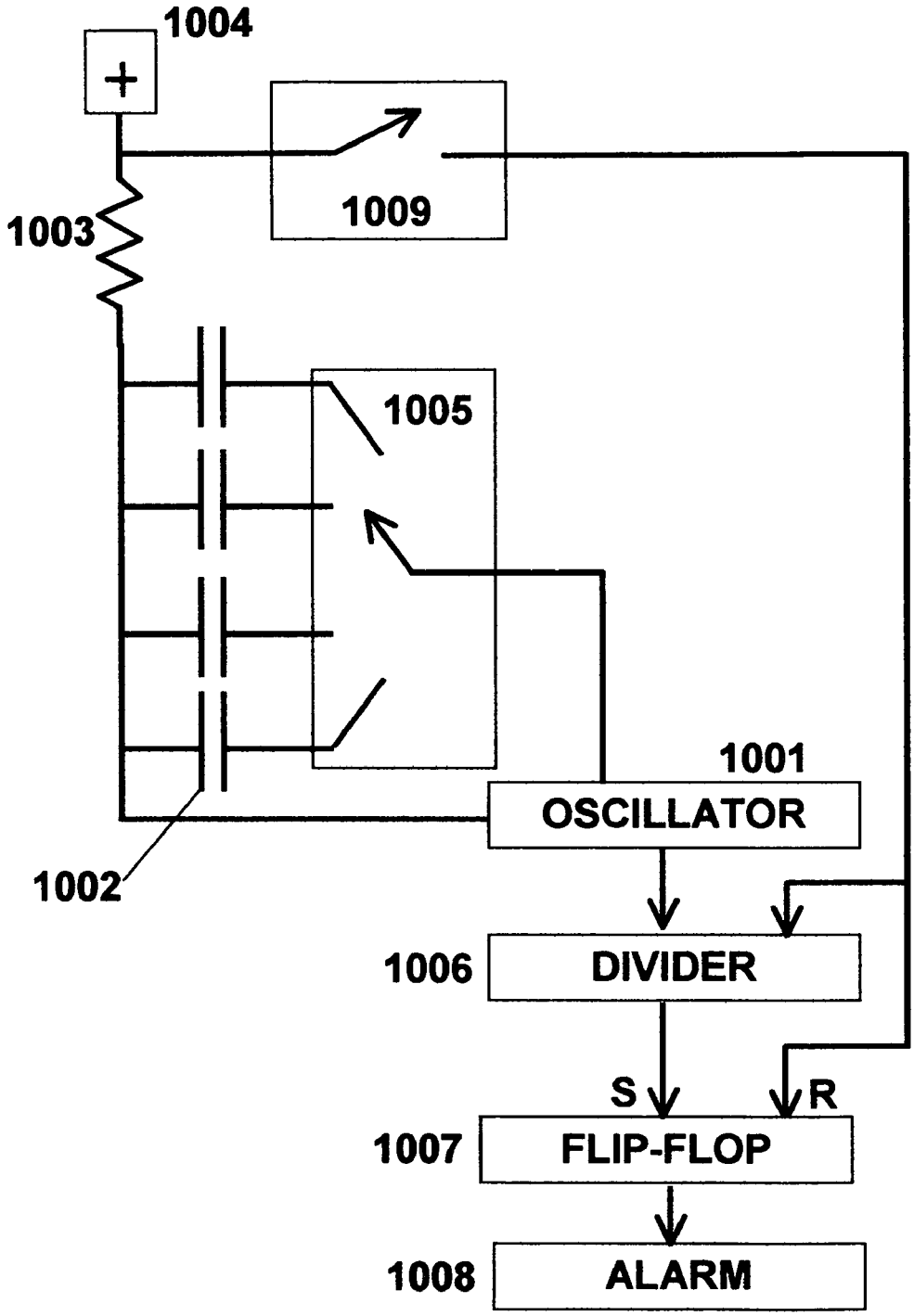
FIG. 10 is a schematic diagram of a timer using an RC oscillator and a frequency divider.

FIG. 10 is a schematic of a timer comprising an RC oscillator 1001 such as a 555-type circuit, which produces pulses at a frequency determined by charging a capacitor 1002 through a resistor 1003 connected to the positive power supply 1004. A selector switch 1005 selects one capacitor 1002 so as to obtain the desired pulse frequency. The pulses go to a divider 1006 such as a 4020-type circuit that produces one output pulse after receiving 16384 input pulses. The divider 1006 drives a flip-flop 1007, such as a 74C107, through the set or "S" input which sets the flip-flop 1007. The flip-flop 1007 then sends a signal activating the alarm 1008. The flip-flop 1007 remains set until the cover switch 1009 is released, which resets the flip-flop 1007 using the reset or "R" input, thus deactivating the alarm 1008. The cover switch 1009 also resets the divider 1006. Specific values can readily be calculated for the various components. If the dose regimen calls for two doses per day, a 12-hour interval between doses, then the oscillator 1001 must produce pulses with a period of 12 hours divided by 16384, or 2.637 seconds. The oscillator 1001 typically produces output pulses with a period of about 0.694 RC where R is the resistance of the resistor 1003 in ohms and C is the capacitance of the capacitor 1002 in farads. Choosing a 10 megohm resistor, the capacitor 1002 should be $C=2.637/(0.694*10^7)=0.38$ microfarads to obtain a time interval of 12 hours. Likewise, the other capacitors should be 0.76 microfarads for one dose per day, 0.19 microfarads for four doses per day, and so on.

Figure 11:
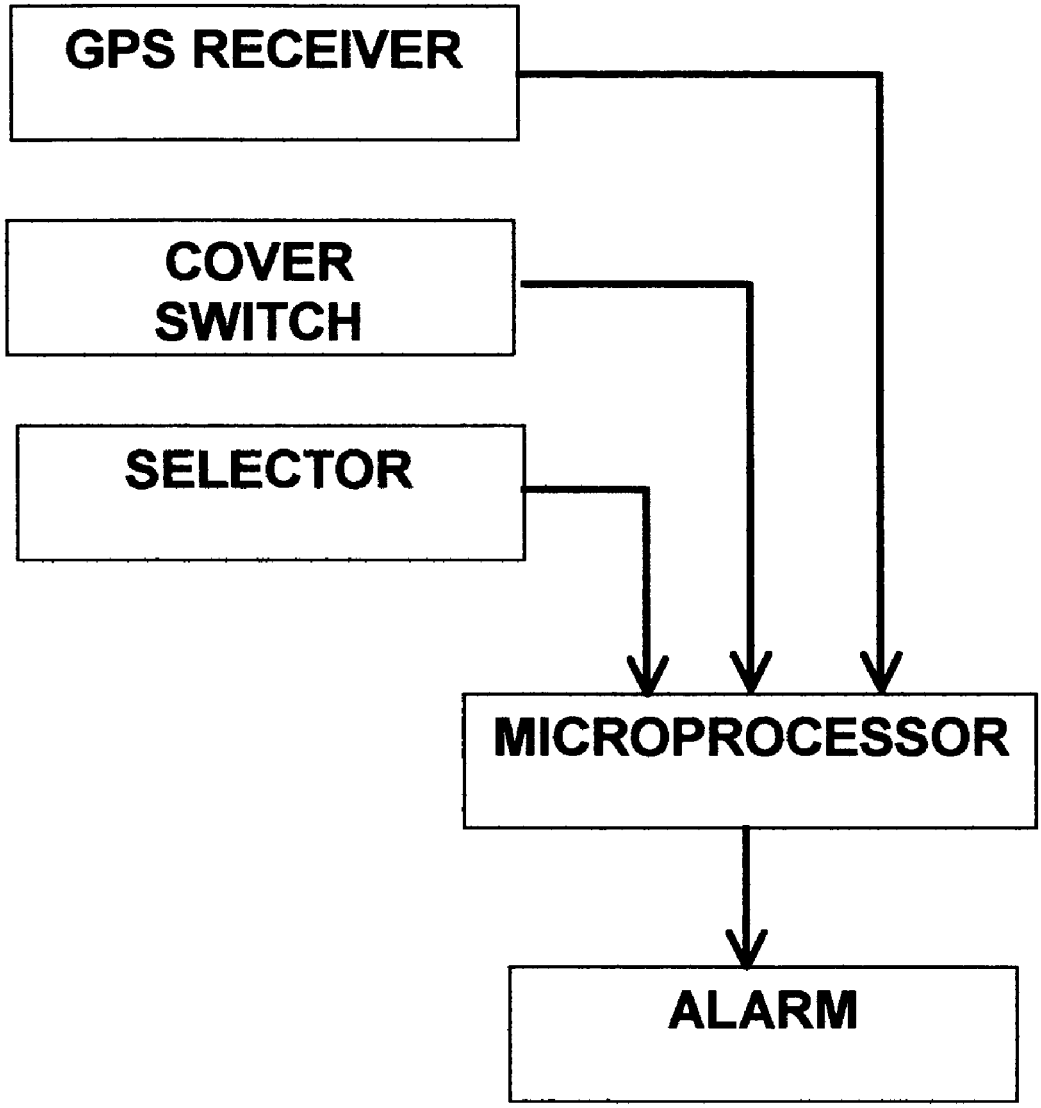
FIG. 11 is a schematic of a timer based on an external timing signal.

FIG. 11 is a schematic of a timer comprising a microprocessor, a cover switch, a selector, a GPS receiver, and an alarm. The GPS receiver periodically sends time information to the microprocessor. The cover switch indicates to the microprocessor when the medicine is taken. The selector indicates which dose time interval is to be used, by selecting one memory location in the microprocessor containing that dose time interval value. When the cover switch is changed from open to closed, the switch causes the microprocessor to calculate an end time by adding the selected dose time interval to the time at which the cover switch was closed. The microprocessor then periodically checks the current time using GPS signals, and compares the time information to the calculated end time. When the current time equals or exceeds the calculated end time, the microprocessor activates the alarm. When the cover switch is again opened, the microprocessor deactivates the alarm.

Figure 12:
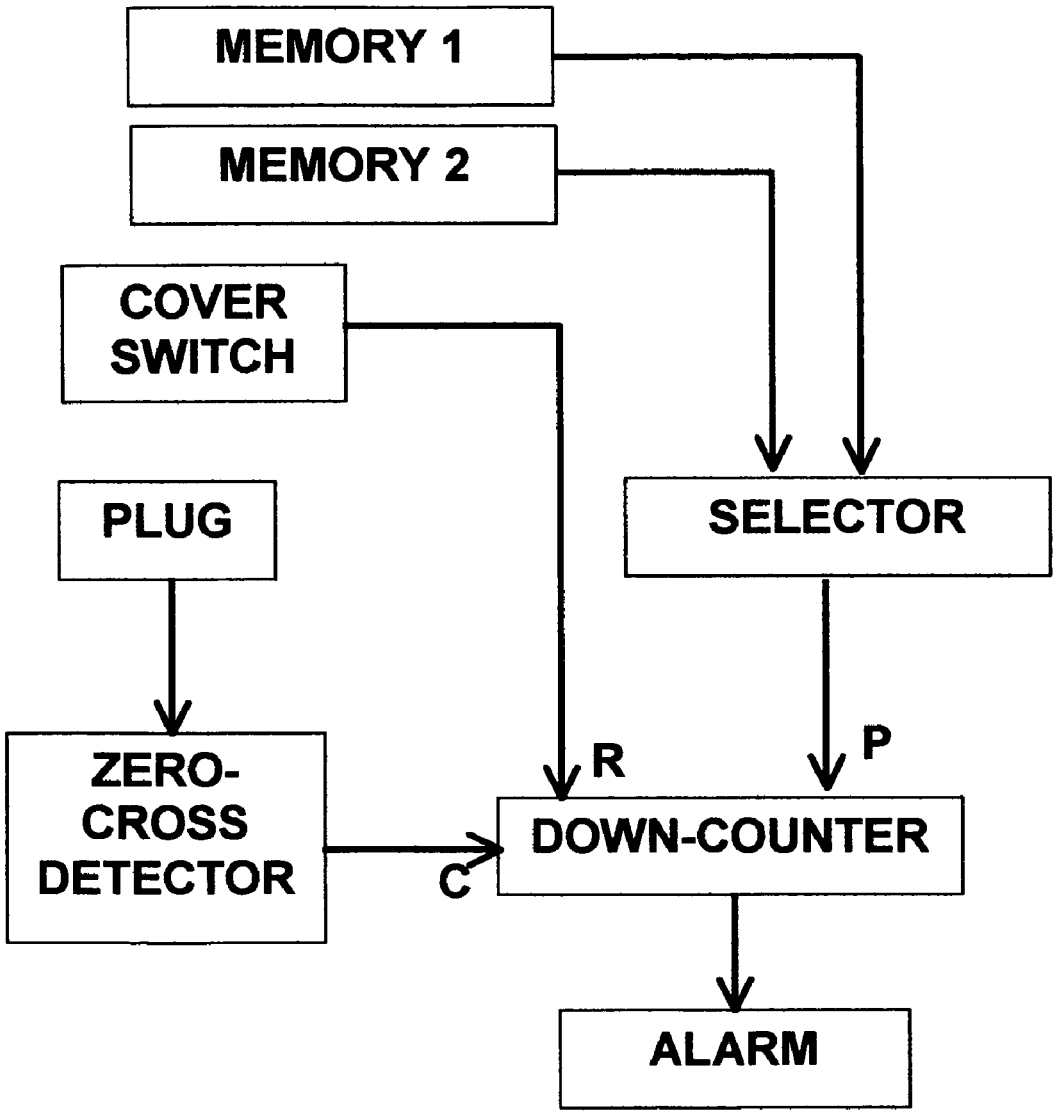
FIG. 12 is a schematic of a timer using alternating-current power as a time base.

FIG. 12 is a schematic of a timer that counts cycles of line voltage, which alternates at a particular frequency. The circuit monitors the voltage using a plug which plugs into a wall socket and conveys the voltage to a zero-cross detector circuit. The zero-cross detector emits a pulse when the input wave passes through zero voltage, thus generating a particular pulse frequency which is the line frequency (or twice the line frequency, depending on circuit details). A down-counter counts those pulses which are applied to the count or "C" input of the counter. The counter is also controlled by the cover switch, connected to the reset or "R" input, and the selector connected to the pre-load or "P" input. A pre-load value is equal to the pulse frequency times the desired dose interval in seconds. When the cover switch is closed, the selector selects one of two memory locations holding pre-load values corresponding to two dose intervals, and applies it to the counter pre-load inputs. When the cover switch is then closed, the reset condition is lifted, and the down-counter begins decrementing from the pre-loaded value. The counter then decrements upon each pulse and activates the alarm when the counter reaches zero, indicating that the dose time is complete. When the cover switch is again opened, the counter is reset, thus deactivating the alarm.

The embodiments and examples provided herein illustrate the principles of the invention and its practical application, thereby enabling one of ordinary skill in the art to best utilize the invention. Many other variations and modifications and other uses will become apparent to those skilled in the art, without departing from the scope of the invention, which is to be defined by the following claims.

I claim:

1. A timing medicine holder comprising a base, a cover, a sensor, a selector, a timer, and an alarm, wherein:

the base supports a labeled medicine container, which contains and identifies a medicine that is to be taken in doses according to a particular dose regimen;

the cover, cooperating with the base, has a closed position enclosing the medicine container, and an open position wherein the medicine container is accessible and not enclosed;

the sensor detects the open and closed positions of the cover and triggers the timer when the cover changes positions;

the selector selects a time interval according to the particular dose regimen;

the timer, upon being triggered by the sensor, generates a time delay according to the selected time interval, and then activates the alarm;

and the alarm then generates an alarm signal indicating that a dose of the medicine is to be taken;

and which further includes a special-access control that, when operated, prevents the sensor from triggering the timer, thereby allowing the cover to be opened and closed without interrupting the time delay.

2. The medicine holder of claim 1 wherein the sensor triggers the timer when the cover is moved from the closed position to the open position.

3. The medicine holder of claim 1 wherein the sensor triggers the timer when the cover is moved from the open position to the closed position.

4. The medicine holder of claim 1 wherein the selector selects the time interval from among a plurality of predetermined time intervals, each predetermined time interval corresponding to a different dose regimen.

5. The medicine holder of claim 1 which further provides means for indicating the selected time interval.

6. The medicine holder of claim 1 which further provides means for indicating a dose frequency corresponding to the selected time interval.

7. The medicine holder of claim 1 wherein the alarm signal is in the list of: light signals, sound signals, mechanical signals, and wireless signals.

8. The medicine holder of claim 1 wherein the sensor deactivates the alarm when the cover is opened.

9. The medicine holder of claim 1 which further includes means for indicating when a dose may be taken earlier than the selected time delay corresponding to the dose regimen.

10. The medicine holder of claim 1 which further includes a late-dose alert, which emits signals distinct from the alarm signal of claim 1, and at a time substantially later than the alarm signal of claim 1, thereby indicating that a dose is overdue.

11. The medicine holder of claim 1, wherein the base is generally planar.

12. The medicine holder of claim 1, wherein the cover is substantially larger than the base.

13. The medicine holder of claim 1, wherein the cover is sufficiently sized and shaped to retain a tall tubular medicine container therein.

14. The medicine holder of claim 1, wherein the base has a rotary selector on a periphery side thereof.

15. The medicine holder of claim 14, wherein the rotary selector indicates and inputs a dose frequency, in doses per day, corresponding to a particular time interval.

16. The medicine holder of claim 1, wherein the cover is transparent.

17. The medicine holder of claim 16, wherein the cover is shaped and positioned in such a fashion that the labeled medicine container is visible through the cover.

18. The medicine holder of claim 1, wherein the base is generally planar; the cover has four side walls and a top.

19. The medicine holder of claim 18, wherein the top is parallel with the base.

20. The medicine holder of claim 19, wherein the four side walls are angled relative to the base such that the top of the cover is smaller than the base.

* * * * *